United States Patent [19]

Galluzzo

[11] 4,047,490

[45] Sept. 13, 1977

[54] RECUPERATIVE HEATING SYSTEM

[76] Inventor: Vincent Galluzzo, 8548 Oakleigh Road, Baltimore, Md. 21234

[21] Appl. No.: 720,671

[22] Filed: Sept. 7, 1976

[51] Int. Cl.[2] ..... F23L 15/04

[52] U.S. Cl. ..... 110/56; 165/155; 432/201; 432/223

[58] Field of Search ..... 110/56; 165/128, 130, 165/154, 155; 432/201, 223

[56] References Cited

U.S. PATENT DOCUMENTS

| | | | |
|---|---|---|---|
| 3,238,902 | 3/1966 | Escher | 110/56 |
| 3,346,042 | 10/1967 | Seehausen | 165/154 |
| 3,407,870 | 10/1968 | Braune et al. | 165/155 |
| 3,446,279 | 5/1969 | White et al. | 165/155 |
| 3,829,285 | 8/1974 | Beck | 432/223 |

*Primary Examiner*—Kenneth W. Sprague
*Attorney, Agent, or Firm*—Joseph Scafetta, Jr.

[57] ABSTRACT

A recuperative heating system has a heat conductive chimney flue; a fuel combustion chamber exhausting hot waste gases and smoke upwardly through the flue; coaxial ducts about the flue, defining a fresh air flow path downwardly from a cool air intake along the outer duct and upwardly along the inner duct into direct heat exchange relationship with the outer surface of the flue and exhausting outwardly from the inner duct into a warm air room vent; and a plurality of U-shaped conduit tubes, each having its bight within the flue. The legs of each U-shaped tube are of different lengths with the inlet end on the longer leg opening into the outer duct and the outlet end on the shorter leg opening into the inner duct.

5 Claims, 3 Drawing Figures

RECUPERATIVE HEATING SYSTEM

BACKGROUND OF THE INVENTION

1. Field of the Invention

This invention relates to heating systems, in particular furnaces, stoves, and fireplaces that utilize recuperative heat exchangers.

2. Description of the Prior Art

This invention is an improvement upon applicant's invention disclosed in U.S. Pat. No. 3,888,231.

Due to the present energy crisis, there is much national concern about the conservation of energy and the efficient utilization of natural fuel resources. Many heating systems take in cool air from a downcoming duct, heat the air, and pass it upward through conventional ducting to room vents. The hot combustion gases and smoke from the burned fuel pass upwardly through a chimney flue or smokestack to be exhausted outside the building. Prior art devices have attempted to utilize this waste heat but have not met with much commercial success. Exemplary apparati are shown and described in French Pat. No. 629,889, U.S. Pat. No. 1,797,909, Belgian Pat. No. 541,279, and Swedish Pat. No. 183,933. Thus, conservation of fuel resources by simple, cheap, and efficient warming of cool air by extraction of waste heat contained in the hot smoke passing upwardly through a chimney flue remains a problem in the heating art.

SUMMARY OF THE INVENTION

It is a primary object of the invention to conserve fuel resources by providing a simple, cheap, and efficient system for warming cool air by passing the same in heat exchange relationship with the hot smoke passing upwardly in heat conductive chimney flue. The advantage of this recuperative heating system is that adept placement of heat exchangers exploits the natural tendency of cool air to fall due to its lesser kinetic energy and the concomitant tendency of warm air to rise due to its greater kinetic energy, by causing a pressure difference between the air at the inlet and at the outlet of each heat exchanger. As a result of this pressure difference, the heating of much incoming cool air is accomplished by the absorption of waste heat from the hot smoke in the heat conductive flue instead of by direct heating in the combustion chamber, thus resulting in a saving of fuel resources.

DESCRIPTION OF THE PREFERRED EMBODIMENT

Figure 1:
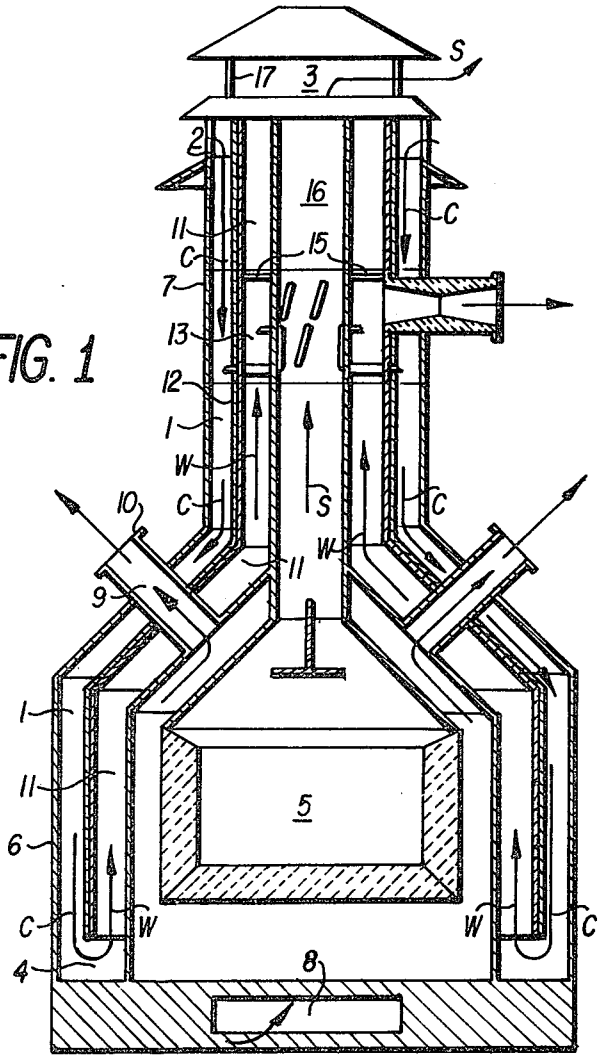
FIG. 1 is a longitudinal section of a heating system employing the heat conductive chimney flue having a plurality of the conduit tubes of the present invention.

In FIG. 1 a recuperative heating system has an outer intake duct 1 and an inner duct 11 which are coaxial with the longitudinal centerline of a central cylindrical chimney flue 16. Chimney cap 3 has a fresh air inlet 2 for cool air C and an outlet 17 for hot smoke S. Intake duct 1 extends down the entire length, and inner duct 11 extends up the entire length, of the heating system.

Open space 4 is an air passageway from intake duct 1 to the inner duct 11.

The heating system has a fuel combustion chamber 5 which exhausts hot waste gases and smoke S upwardly through chimney flue 16. Walls 6 and 7 of sheet metal construction surround the combustion chamber portion and the chimney portion, respectively, of the heating system.

A hearth vent 8 is located in the base of the heating system. A vent 9 has a register 10 that enters a room on the lower level of the building to be heated.

Figure 2:
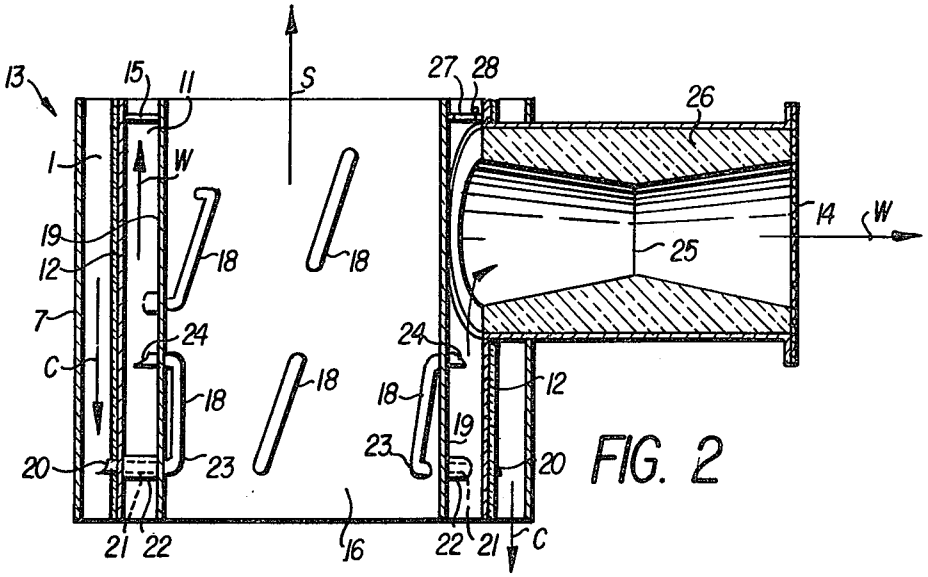
FIG. 2 is a cross-sectional view of a preferred embodiment of a tee in the flue incorporating a plurality of the conduit tubes of the present invention.
Figure 3:
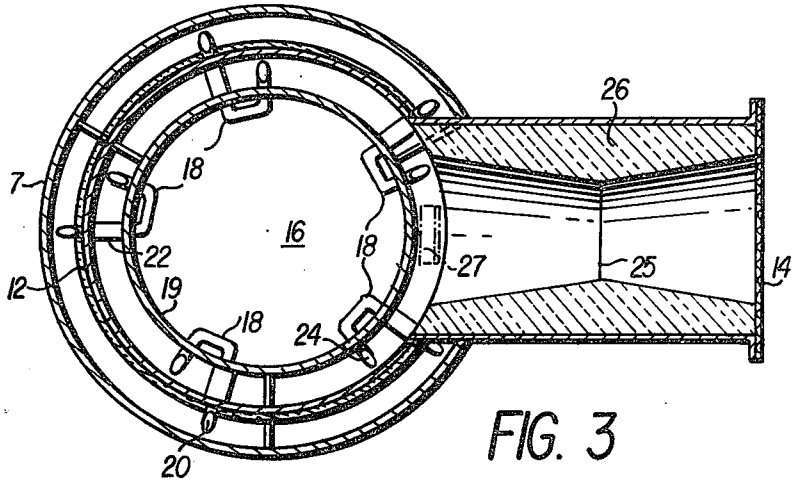
FIG. 3 is a top plan view of the preferred embodiment illustrated in FIG. 2.

The inner coaxial duct 11 has an insulated wall 12 separating it from the outer coaxial cool air duct 1. A tee 13 is placed in the chimney wherever a register or screen 14, as shown in FIGS. 2 and 3, is positioned in the upper level of the building. Although the tee 13, as best illustrated in FIG. 2, is shown with only one register 14, it is understood that the tee may also have two or more such registers, for example at 90° or 180° from illustrated register 14. It is also understood that there may be a plurality of tees 13 along the length of the chimney if the building to be heated has more than two levels. If a plurality of tees 13 are utilized, it will be necessary, of course, in order for warm air to be drawn through the room vents on the lower levels, that forced circulation be employed, for example, by placement of a fan in each lower level room vent. A flat annular collar 15 functions as a warm air stop near the top of the highest tee 13 in the chimney and seals inner coaxial duct 11.

FIGS. 2 and 3 show conduit means or tubes 18 disposed in a wall 19. Preferably, a plurality of tubes 18 are arranged around the wall 19 of tee 13. Also, the tubes 18 may be arranged along the entire length of chimney flue 16. Each tube 18 may be constructed entirely of heat conductive material, such as copper tubing, but it is necessary that only the heat exchange surface of the midsection, to be described hereinafter, be heat conductive. Each tube 18 is generally U-shaped and is disposed on its side with its lower inlet leg longer than its upper outlet leg.

Each tube 18 has a scoop section 20 on its longer leg extending into the cool air intake duct 1 and a short transition section 21, preferably horizontal or inclined slightly upward from the horizontal, which extends across warm air duct 11. A short spacer tube 22 of heat conductive material, preferably copper, surrounds transition section 21 and separates wall 19 from wall 12. Each tube 18 has its bight or intermediate section 23 within the chimney flue 16. Although intermediate section 23 may be vertical and close to wall 19, it is preferred to orient section 23 at an angle therefrom and to space it a short distance away from wall 19 in order to place more of the surface of section 23 in direct heat exchange relationship with the hot smoke S. The end section 24 on the shorter leg of each tube 18 is horizontal, or inclined slightly upward from the horizontal, and has an outlet connected into the warm air duct 11.

Warm air duct 11 exits into one or more vents 25 having insulation 26. In the collar 15 at the top of the warm air duct 11, there is a safety lid 27 of light sheet metal construction secured to the collar 15 by a light spring hinge 28. Although only one such lid 27 is shown in phantom lines in FIG. 3, it is understood that there may be a plurality of such lids 27 spaced around the collar 15.

The operation of the heating system incorporating the preferred embodiment of the present invention is as follows. Fuel combustion chamber 5 draws cool air near the floor of the building into hearth vent 8 to be heated. The heated air passes into vent 9 and through register 10 to warm the rooms on the lower level of the building. The hot waste gases and smoke S from the burned fuel pass upward through chimney flue 16 to be exhausted outside the building through exit 17. The rising hot smoke S in chimney flue 16 radiates heat through wall 19 which increases the kinetic energy of the air in duct 11, thus causing an upward draft therein. Radiated heat does not pass through to duct 1 because wall 12 is insulated to prevent radiation therethrough.

Due to the open space 4 communicating duct 11 with duct 1, the upward draft in duct 11 causes a corresponding downward draft in duct 1. This downward draft draws cool air C through inlet 2 in chimney cap 3 into intake duct 1. Because the cool air C passes downward through the outer coaxial duct 1, walls 6 and 7 of the heating system remain cool to the touch. This feature allows the heating system to be installed in buildings of wooden frame construction as well as those of masonry construction without fear of the heating system walls combusting the wooden framework.

When the cool air C in duct 1 reaches the open space 4, it is drawn upward into duct 11 wherein it is warmed by heat radiation from the chimney flue 16 through wall 19. The warm air W continues to pass upward until it is stopped by collar 15 in tee 13 and diverted into vent 25 through register 14 to heat the room in the upper level of the building. Insulation 26 prevents warm air W in vent 25 from being cooled by the downcoming cool air C in duct 1.

A fan (not shown) may optionally be placed at the entrance or at the narrowest point of vent 25 to facilitate the upward draft of the warm air W in duct 11 and to aid the diversion of such air from duct 11 through vent 25 into the room to be heated.

In the event that vent 25 should become clogged or register 14 should become blocked, warm air W must escape to prevent a build-up of excessive heat and pressure in duct 11. Such a build-up is avoided because lightweight lid 27 in collar 15 is flipped open against light spring hinge 28 by the upward force of the warm air W. The opening of lid 27 relieves the excessive heat and pressure in duct 11. The escaping warm air W passes upward and is exhausted outside the building through exit 17. When vent 25 is unclogged or the register 14 cleared, the resumption of the flow of warm air W into vent 25 allows the light spring hinge 28 to close lid 27 in collar 15.

As best shown in FIG. 2, the warm air W in duct 11 is augmented by warm air supplied by tubes 18 of the present invention. As the warm air W in duct 11 and each tube 18 is heated by the hot smoke S, a pressure difference results between the air at inlet 20 and at outlet 24 of tube 18. This difference causes some of the downcoming cool air C in intake duct 11 to be drawn into the tubes 18. Each tube 18 has an inlet with a scoop section 20 to facilitate entry of cool air C into tube 18. As the air is drawn further inward in each tube 18, it is warmed in section 21 and further heated in heat exchange section 23 by the hot smoke S passing upward through chimney flue 16. This direct heat exchange relationship between the upward moving air in section 23 of each tube 18 and the hot smoke S in heat conductive chimney flue 16 results in the heating of such air and in the cooling of the smoke S. This utilization of the heat in the smoke S that would otherwise be wasted by passage to the outside of the building results in a savings of fuel that would otherwise be utilized to heat such cool air if it were to pass directly to the hearth vent 8 of the fuel combustion chamber 5. The heated air in section 23 rises due to the pressure drop across the ends of the tube and the increased kinetic energy imparted to it by the hot smoke S and passes through end section 24, thereby exiting from tube 18 to commingle with the warm air W passing upward in duct 11. The commingled warm air W thereafter passes into vent 25 for heating a room in the upper level of the building.

The foregoing preferred embodiment is considered as illustrative only. Numerous modifications and changes will readily occur to those skilled in the art. For example, the chimney flue and its coaxial ducts may have square, rectangular or other polygonal cross-sections rather than circular cross-sections. Also, the chimney flue and ducts need not be coaxial but may be telescopingly spaced in any manner, for example, eccentrically, as long as the tubes of the present invention withdraw cool air from the intake duct for direct heat exchange with the hot smoke in the chimney flue and subsequent upward passage into the warm air duct. Furthermore, the fuel combustion chamber 5 may be a furnace, stove, or fireplace. Finally, of course, the dimensions of the tubes 18, chimney flue 16, and ducts 1 and 11 may vary, depending upon the size of the chimney already installed or the design choice of the builder.

I claim:

1. A recuperative heating system, comprising:

a. a heat conductive chimney flue;

b. a fuel combustion chamber exhausting hot waste gases and smoke upwardly through said flue;

c. duct means, telescopingly spaced about said flue, defining a fresh air flow path downwardly along the outer of said duct means and upwardly along the inner of said duct means into direct heat exchange relationship with the outer surface of said flue and exhausting outwardly from said inner duct means; and d. a plurality of conduit means, each having an intermediate heat exchange section within said flue, with the inlet end of each said conduit means opening into said outer duct means and the outlet end of each said conduit means opening into said inner duct means.

2. A recuperative heating system, according to claim 1, wherein said telescopingly spaced duct means and said flue are coaxial.

3. A recuperative heating system, according to claim 1, wherein each said conduit means has at its inlet end a scoop section extending into said outer duct means.

4. A recuperative heating system, according to claim 1, wherein each said conduit means has its intermediate heat exchange section angled from the vertical direction within said flue.

5. A recuperative heating system, according to claim 1, wherein each said conduit means has a transition section integral with said inlet end of each said conduit means at one end, extending across said inner duct means, and integral with said intermediate heat exchange section of each said conduit means at the other end.

* * * * *